US005078337A

United States Patent [19]

Waller

[11] Patent Number: 5,078,337

[45] Date of Patent: Jan. 7, 1992

[54] FIN ASSEMBLY FOR A PROJECTILE

[75] Inventor: George C. Waller, Preston, United Kingdom

[73] Assignee: British Aerospace Public Limited Company, London, England

[21] Appl. No.: 371,586

[22] Filed: Jun. 26, 1989 (Under 37 CFR 1.47)

[30] Foreign Application Priority Data

Jun. 24, 1988 [GB] United Kingdom ..... 8815060

[51] Int. Cl.[5] ..... F42B 10/14

[52] U.S. Cl. ..... 244/3.28

[58] Field of Search ..... 244/3.27, 3.28, 3.29, 244/3.26, 49; 102/385, 386, 388

[56] References Cited

U.S. PATENT DOCUMENTS

| | | | |
|---|---|---|---|
| Re. 26,380 | 4/1968 | Rogallo | 244/49 |
| 2,666,387 | 1/1954 | Richey | 102/385 |
| 3,188,957 | 6/1965 | Petre | 102/386 |
| 3,369,780 | 2/1968 | Wieland et al. | 244/49 |
| 3,430,562 | 3/1969 | Sautier | 244/49 |
| 4,411,398 | 10/1988 | Wedertz et al. | 244/3.28 |
| 4,586,681 | 5/1986 | Wedertz et al. | 244/3.27 |

FOREIGN PATENT DOCUMENTS

| | | |
|---|---|---|
| 1563898 | 4/1969 | France . |
| 589346 | 6/1947 | United Kingdom . |
| 1024103 | 3/1966 | United Kingdom . |
| 2059023 | 4/1981 | United Kingdom . |
| 1597098 | 9/1981 | United Kingdom . |
| 1597351 | 9/1981 | United Kingdom . |
| 2115116 | 9/1983 | United Kingdom . |
| 2115117 | 9/1983 | United Kingdom . |
| 2149481 | 6/1985 | United Kingdom . |
| 2159930 | 12/1985 | United Kingdom . |
| 2181522 | 4/1987 | United Kingdom . |

*Primary Examiner*—Michael J. Carone
*Attorney, Agent, or Firm*—Young & Thompson

[57] ABSTRACT

A fin assembly comprises a plurality of fin elements 12 each formed of flexible sheet material (e.g. cloth) which are stowed in collapsed form adjacent the aft motor nozzle and are deployed to an extended form on which they provide effective aerodynamic surfaces.

8 Claims, 2 Drawing Sheets

FIN ASSEMBLY FOR A PROJECTILE

This invention relates to a fin assembly for a projectile and, more particularly but not exclusively, to a fin assembly for a projectile to be launched from a launch container such as a launch tube.

There are many known fin assemblies which include a plurality of deployable rigid fin members. For example the fin members may be pivotally mounted about hinge axes lying parallel to the longitudinal axis of the projectile for movement between a stowed position adjacent the projectile body and a deployed position. These types of arrangement which employ rigid fins tend to be too complex and occupy too large a volume to be useful for tube-launched projectiles. To reduce storage volume, it has been proposed to make the fin members curved so that they fit closely against the cylindrical aft portion of the missile when stowed. This arrangement has the disadvantage that high roll rates are induced because of the fin curvature.

The fin assembly disclosed herein is intended for a missile known as a vertical ballistic weapon which is launched from a launch tube on board an aircraft located at an angle to the vertical (typically 25°). The motor of the missile burns only whilst the missile is travelling within its tube and provides a rearward speed component just sufficient to counteract aircraft foward speed. The missile thus falls vertically but initially with a relatively high angle of attack to the incident air flow. Such a missile requires a fin which may be stored in a very small volume but which has sufficient aerodynamic effectiveness to orient the missile rapidly with optimum damping so that it falls vertically with minimal angle of attack. The invention is not however limited to fins for such missiles as the fins disclosed herein may be used on other projectiles, for example shoulder launched missiles.

According to one aspect of this invention, there is provided a fin assembly for a projectile, said fin assembly including a plurality of fin elements of flexible sheet material (for example a cloth material) movable between a stowed position adjacent the projectile body in which the fin element is in a generally collapsed state, and an extended position in which the fin element is supported in a generally planar state, and aerodynamically driven deployment means for moving the fin member to said extended position.

A non-limiting example of this invention will now be described in detail, reference being made to the accompanying drawings, in which.

Figure 1:
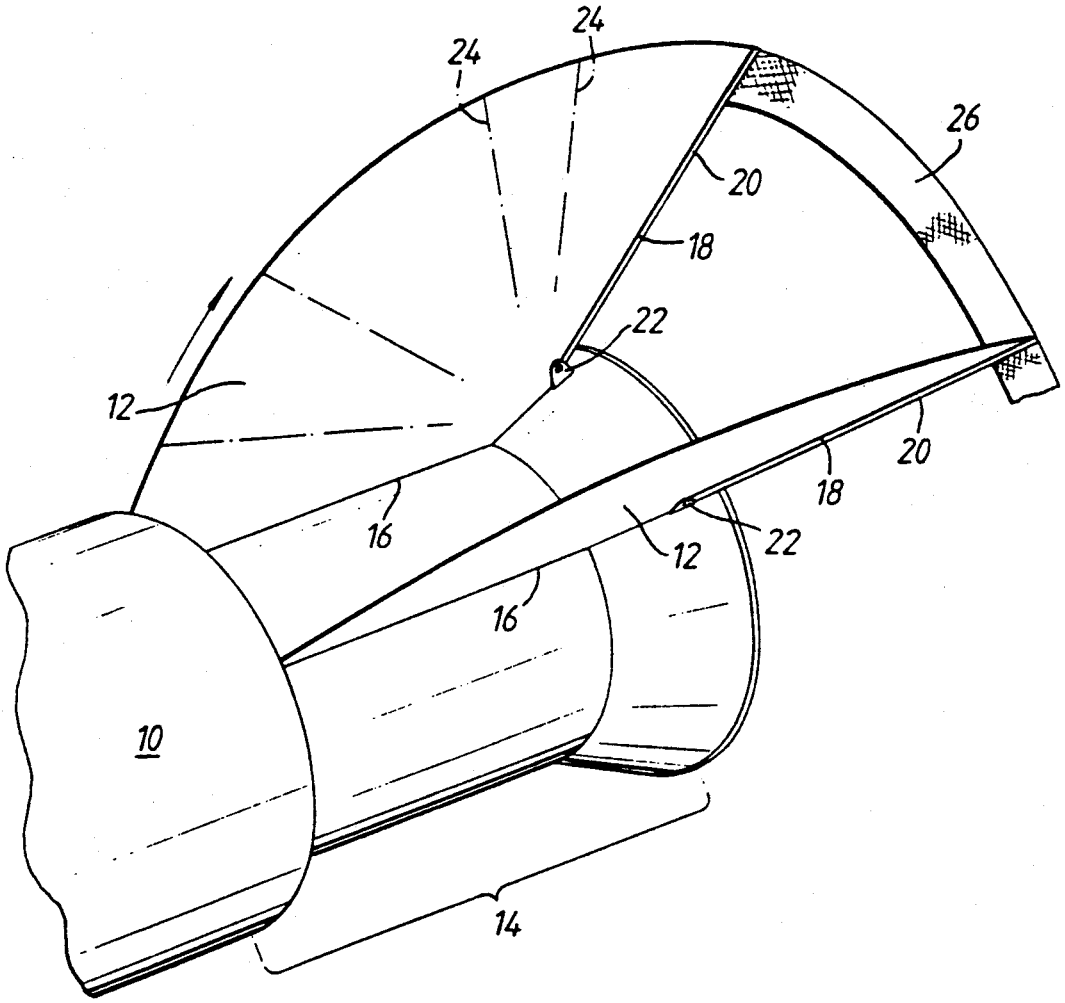
FIG. 1 is a general perspective view of the aft portion of a projectile including an embodiment of fin assembly of this invention with certain parts removed for clarity and showing the fin elements in a deployed condition.

The projectile 10 illustrated in the drawings is intended to be tube launched and includes a fin assembly having seven fabric fin elements 12 equispaced around a motor nozzle 14 at the aft end of the projectile. FIG. 1 shows only two of the fin elements.

Each fin element 12 of the assembly is of flexible sheet material, for example made up from woven KEVLAR (Registered Trade Mark) fibre or sail cloth. Each fin element 12 is generally sector shaped and one edge

16 thereof is fixedly supported by suitable means attaching it to the cylindrical outer wall of the motor nozzle 14. The other edge 18 is attached to a movable rigid trailing edge member 20 which is pivotally attached at 22, e.g. by a lug and screw arrangement, to the flared outer wall of the motor nozzle 14. Between the edges 16 and 18, the fin element includes a plurality of spokes 24 which enhance the effective stiffness of the fin element 12 when deployed. The spokes 24 preferably extend radially from the outer edge of the deployed fin element to a point part way towards the attachment 22. The spokes may be secured by sewing within pockets of the fin element element. The free end portions of adjacent trailing edge members 20 are spanned by a ribbon 26 of similar material to that of the fin elements.

Figure 2:
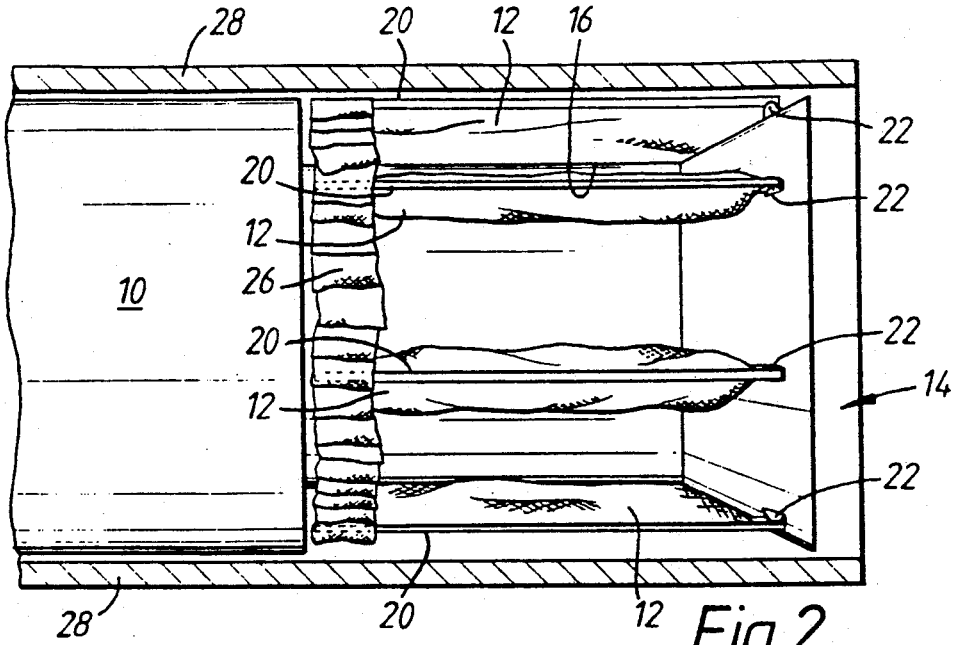
FIG. 2 is a side view of the aft portion of the projectile of FIG. 1 with the fin elements in a stowed condition.
Figure 3:
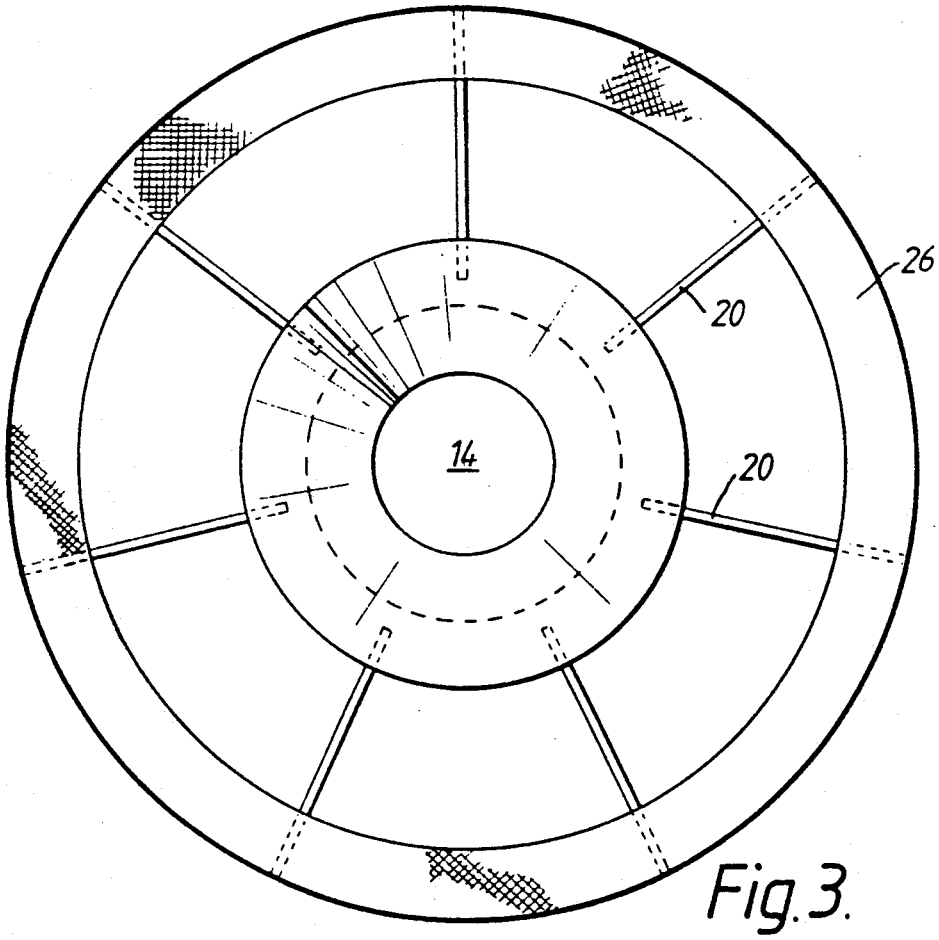
FIG. 3 is a rear end view of the projectile of FIG. 1.

Referring to FIG. 2, the projectile is stored prior to launch in a launch tube 28 with the trailing edge members 20 folded forwardly to lie generally parallel to the cylindrical surface of the motor nozzle 14 and at the same radius as the projectile body forward of the motor nozzle 14. The fin elements 12 collapse concertina-fashion to lie between the associated trailing edge member 20 and the outer surface of the motor nozzle 14. The ribbon 26 lies outside the trailing edge members 20. The outer forward surfaces of the trailing edge members preferably contact associated guide surfaces on the inside of the launch tube to provide lateral stability to the missile during launch and to act as a bourrelet.

On launch, the projectile leaves the launch tube 28 and is propelled by the motor. On leaving the launch tube, the ribbon 26 is pulled rearwardly as the projectile moves forwardly through the air, thus causing the trailing edge members 20 to unfold to their deployed position, moving the fin elements 12 to a planar condition. The ribbon also applies an unfolding torque to the trailing edge members 20 throughout flight of the projectile, applying tension to the fin members to maintain them in a planar or generally planar condition.

The fin elements 12 are preferably radar transparent or absorbent so that the radar signature of the projectile is minimised. For example the fins may either be thin enough to be radar transparent or, if thicker, provided with chopped carbon or another absorbent filter.

In this arrangement, the fin elements 12 constrain rotation of the trailing edge members and the aerodynamic effectiveness of the illustrated assembly may be more than doubled compared to the umbrella-type design described above.

It should be noted that it is not necessary in all applications for the fin members to be rigidly planar. For example, in some applications it may be advantageous for the fin elements to flap during flight to provide an increasing damping effect.

It will be understood that the shape and number of the fin elements may be varied from those shown in the illustrated example. The fin assembly may be employed at a position forwardly of the aft end portion of the projectile.

I claim:

1. A fin assembly for a projectile, the fin assembly including:

a plurality of fin elements, each comprising a sheet of flexible material, attachment means for attaching an edge region of said fin element to said projectile, a relatively rigid trailing edge member for having one end thereof mounted on said projectile for allowing movement of said edge member with respect to said projectile, each of said fin elements being movable between a stowed position adjacent the projectile in which the fin element is in a generally collapsed state, and an extended position in which the fin element is supported in a generally planar state; and aerodynamically driven deployment means comprising an element of flexible sheet material extending between trailing edge members of adjacent fin elements.

2. A fin assembly according to claim 1, wherein said deployment means is operable to maintain said fin elements in said extended position.

3. A fin assembly according to claim 1, wherein said aerodynamically driven means comprises a ribbon element of flexible sheet material extending between free end portions of adjacent trailing edge members.

4. A fin assembly according to claim 1, wherein each of said fin elements when deployed lies in a respective generally radial plane.

5. A fin assembly according to claim 1, wherein the flexible sheet material does not reflect a substantial amount of radar radiation.

6. A fin assembly according to claim 1, wherein the fin assembly is capable of flexing or flapping when extended.

7. A fin assembly according to claim 1, wherein said fin elements are formed of cloth material.

8. A projectile including a fin assembly, the fin assembly including:

a plurality of fin elements, each comprising a sheet of flexible material, attachment means attaching an edge region of said fin element to said projectile, a relatively rigid trailing edge member, mounting means for mounting one end of said trailing edge member on said projectile for allowing movement of said edge member with respecft to said projectile, each of said fin elements being movable between a stowed position adjacent the projectile in which the fin element is in a generally collapsed state, and an extended position in which the fin element is supported in a generally planar state; and aerodynamically driven deployment means comprising an element of flexible sheet material extending between trailing edge members of adjacent fin elements.

* * * * *